US009451370B2

(12) United States Patent
Hasler et al.

(10) Patent No.: US 9,451,370 B2
(45) Date of Patent: Sep. 20, 2016

(54) METHOD FOR OPERATING A HEARING DEVICE AS WELL AS A HEARING DEVICE

(75) Inventors: Ivo Hasler, Winterthur (CH); Micha Knaus, Jona (CH)

(73) Assignee: SONOVA AG, Staefa (CH)

( * ) Notice: Subject to any disclaimer, the term of this patent is extended or adjusted under 35 U.S.C. 154(b) by 0 days.

(21) Appl. No.: 14/382,107

(22) PCT Filed: Mar. 12, 2012

(86) PCT No.: PCT/EP2012/054204

§ 371 (c)(1),
(2), (4) Date: Aug. 29, 2014

(87) PCT Pub. No.: WO2013/135263

PCT Pub. Date: Sep. 19, 2013

(65) Prior Publication Data

US 2015/0030191 A1 Jan. 29, 2015

(51) Int. Cl.
*H04R 25/00* (2006.01)

(52) U.S. Cl.
CPC ..... *H04R 25/50* (2013.01); *H04R 25/43* (2013.01); *H04R 25/554* (2013.01); *H04R 2225/43* (2013.01); *H04R 2225/55* (2013.01)

(58) Field of Classification Search
CPC ..... H04R 25/554; H04R 2460/01; G10L 2021/02165
See application file for complete search history.

(56) References Cited

U.S. PATENT DOCUMENTS 5,402,496 A * 3/1995 Soli ..... G10K 11/1782 381/71.11
2003/0044033 A1 3/2003 Julstrom
2003/0118197 A1 6/2003 Nagayasu
2005/0117713 A1 6/2005 Waldron
2007/0175202 A1 8/2007 Murrow (Continued)

FOREIGN PATENT DOCUMENTS

EP 1 296 537 A2 3/2003
WO 2008/128563 A1 10/2008

(Continued)

OTHER PUBLICATIONS

International Search Report issued in Application No. PCT/EP2012/054204 dated Oct. 25, 2012.

(Continued)

*Primary Examiner* — Jesse Elbin
*Assistant Examiner* — Ryan Robinson
(74) *Attorney, Agent, or Firm* — Pearne & Gordon LLP

(57) ABSTRACT

A method for operating a hearing device worn by a hearing device user. The method includes picking up an audio signal (a) by an input transducer of the hearing device. The audio signal (a) includes a source signal (s) of a sound source (SS) and a disturbing signal (d) of a disturbing source (DS). The method also includes receiving a transmission signal (d_AIS) via an interface unit of the hearing device. The transmission signal (d_AIS) includes the disturbing signal (d) or at least characteristic features of the disturbing signal (d). The method also includes at least partially eliminating the disturbing signal (d) from the audio signal (a) by using the disturbing signal (d) transmitted by the transmission signal (d_AIS) or by using the characteristic features of the disturbing signal (d) transmitted by the transmission signal (d_AIS) for obtaining an adjusted audio signal (a*), and processing the adjusted audio signal (a*).

14 Claims, 3 Drawing Sheets

(56) References Cited

U.S. PATENT DOCUMENTS

2009/0074216 A1* 3/2009 Bradford ..... H04R 25/554 381/315
2009/0208043 A1 8/2009 Woods
2009/0238377 A1* 9/2009 Ramakrishnan ..... G10L 21/028 381/92
2010/0048131 A1* 2/2010 Hirsch ..... H04R 3/005 455/41.3
2011/0137649 A1* 6/2011 Rasmussen ..... H04R 25/356 704/231
2012/0069242 A1* 3/2012 Pearlstein ..... G10K 11/1788 348/484
2013/0262101 A1* 10/2013 Srinivasan ..... G10L 21/0208 704/226
2015/0098578 A1* 4/2015 Dadu ..... H04B 7/015 381/66

FOREIGN PATENT DOCUMENTS

WO 2009/049645 A1 4/2009
WO 2010/086462 A2 8/2010

OTHER PUBLICATIONS

Written Opinion issued in Application No. PCT/EP2012/054204 dated Oct. 25, 2012.

* cited by examiner

METHOD FOR OPERATING A HEARING DEVICE AS WELL AS A HEARING DEVICE

FIELD OF THE INVENTION

The present invention is related to a method for operating a hearing device that is worn by a hearing device user as well as to a hearing device.

BACKGROUND OF THE INVENTION

Numerous types of hearing devices are known and have been developed to assist individuals with hearing loss. Examples of hearing device types currently available include behind the ear (BTE), in the ear (ITE), in the canal (ITC) and completely in the canal (CIC) hearing devices. In many situations, however, hearing impaired individuals may require a hearing solution beyond known solutions provided by a hearing device alone. For example, hearing impaired individuals often have great difficulty to follow a normal conversations in noisy environments, encountered at parties, meetings, sporting events or the like, involving a high level of background noise. In addition, hearing impaired individuals often also have difficulties listening to audio sources located at a distance from the individual, or to several audio sources located at various distances from the individual and at various positions relative to the individual.

A known hearing aid system comprising a secondary source for audio has been described in US 2003/0044033 A1. The known hearing aid system discloses a selection of two audio sources. A first audio source is called primary source for audio, such as a hearing aid microphone. The hearing aid system comprises a secondary source for audio, such as a directional microphone worn or otherwise supported by a person speaking. In operation, a detection and switch circuitry receives signal transmission from the secondary audio source and determines whether the signal received is desirable. If the signal transmission is desirable, the circuitry selects the signal for coupling with the hearing aid circuitry. If the transmission signal is not desirable, the circuitry selects the signals from the primary audio source for coupling with the hearing aid circuitry.

Further known teachings are disclosed in US 2005/175 202 A1, WO 2008/128 563 A1, EP-1 296 537 A2 and WO 2010/086 462 A2.

The known teachings presume that the hearing aid user's aim is to better hear the alternative input signal (secondary signal), either via the acoustic path or via another transmission manner.

The present invention has the aim to improve hearing of a specific sound source.

Many objects, aspects and variations of the present invention will become apparent to one skilled in the art upon reviewing the prior art and in light of the teachings herein.

SUMMARY OF THE INVENTION

These and other problems experienced by hearing device users are addressed by the methods and the hearing devices of the present invention.

It is pointed out that the term "hearing device"—as it is used in connection with this description of the invention—must not only be understood as a device that is used to improve the hearing of hearing impaired patients, but also as a communication device to improve communication between individuals. In addition, the term "hearing device" comprise hearing device types currently available, as for example behind the ear (BTE), in the ear (ITE), in the canal (ITC) and completely in the canal (CIC) hearing devices. Furthermore, hearing devices may also be fully or partially implantable.

First, the present invention is directed to a method for operating a hearing device that is worn by a hearing device user, the method comprising the steps of:

- picking up an audio signal by an input transducer of the hearing device, the audio signal comprising a source signal of a sound source and a disturbing signal of a disturbing source,
- receiving a transmission signal via an interface unit of the hearing device, the transmission signal comprising the disturbing signal or at least characteristic features of the disturbing signal,
- at least partially eliminating the disturbing signal from the audio signal by using the disturbing signal transmitted by the transmission signal or by using the characteristic features of the disturbing signal transmitted by the transmission signal for obtaining an adjusted audio signal, and
- processing the adjusted audio signal in the hearing device.

An embodiment of the present invention further comprises the steps of:

- calculating a correlation function between the disturbing signal transmitted by the transmission signal and the audio signal,
- determining a delay between the disturbing signal transmitted by the transmission signal and the disturbing signal superimposed on the source signal taking into account said correlation function, and
- eliminating the delay between the disturbing signal transmitted by the transmission signal and the disturbing signal superimposed on the source signal.

Further embodiments of the present invention further comprise the steps of:

- picking up the disturbing signal by a further input transducer, and
- generating the transmission signal from the picked up disturbing signal.

Still further embodiments of the present invention further comprise the steps of controlling by the hearing device user the step of at least partially eliminating the disturbing signal in the audio signal.

In further embodiments of the present invention, the disturbing sound source comprises at least one of the following audio sources:

- television set;
- radio receiver;
- HiFi—(High Fidelity)-unit;
- an input transducer, such as a microphone for picking up surround sound, for example.

In further embodiments of the present invention, the transmission signal is transmitted to the interface unit via implementation of one of the following techniques:

- wireless transmission: proprietary or standardized, e.g. FM—(Frequency Modulation), Bluetooth, WLAN (Wireless Local Area Network);
- wired transmission;
- Network with one or several transmission paths/links.

In further embodiments of the present invention, the characteristic features comprising at least one of the following:

- a time decimated sequence of the disturbing signal;
- a spectrum of the disturbing signal;
- a spectrum of the disturbing signal up to a predefined frequency or within a predefined frequency band;

an approximation of the disturbing signal;

stochastic signal information of the disturbing signal.

Second, the present invention is directed to a hearing device comprising:

an input transducer for picking-up an audio signal that comprises a source signal of a sound source and a disturbing signal of a disturbing source, an interface unit for receiving a transmission signal comprising a disturbing signal or at least characteristic features of the disturbing signal of a disturbing source, and a signal processing unit for at least partially eliminating the disturbing signal from the audio signal by using the disturbing signal transmitted by the transmission signal or by using the characteristic features of the disturbing signal transmitted by the transmission signal for obtaining an adjusted audio signal, the signal processing unit being operationally connected to the interface unit.

An embodiment of the present invention further comprises:

means for calculating a correlation function between the disturbing signal transmitted by the transmission signal and the audio signal, means for determining a delay between the disturbing signal transmitted by the transmission signal and the disturbing signal superimposed on the source signal taking into account said correlation function, and means for eliminating the delay between the disturbing signal transmitted by the transmission signal and the disturbing signal superimposed on the source signal.

Further embodiments of the present invention further comprise:

a further input transducer for picking up the disturbing signal, and means for generating the transmission signal from the picked up disturbing signal.

Still further embodiments of the present invention further comprise a control unit operated by the hearing device user in order to control the means for at least partially eliminating the disturbing signal from the audio signal.

In further embodiments of the present invention, the disturbing source comprises at least one of the following audio sources:

television set;

radio receiver;

HiFi—(High Fidelity)-unit;

an input transducer, such as a microphone for picking up surround sound, for example.

In further embodiments of the present invention, the transmission signal is transmitted to the interface unit via implementation of one of the following techniques:

wireless transmission: proprietary or standardized, e.g. FM—(Frequency Modulation), Bluetooth, WLAN (Wireless Local Area Network);

wired transmission;

Network with one or several transmission paths/links.

In further embodiments of the present invention, the characteristic features comprising at least one of the following:

a time decimated sequence of the disturbing signal;

a spectrum of the disturbing signal;

a spectrum of the disturbing signal up to a predefined frequency or within a predefined frequency band;

an approximation of the disturbing signal;

stochastic signal information of the disturbing signal.

It is expressly pointed out that any combination of the above-mentioned embodiments, or combinations of combinations, is subject to a further combination. Only those combinations are excluded that would result in a contradiction.

DETAILED DESCRIPTION OF THE INVENTION

Figure 1:
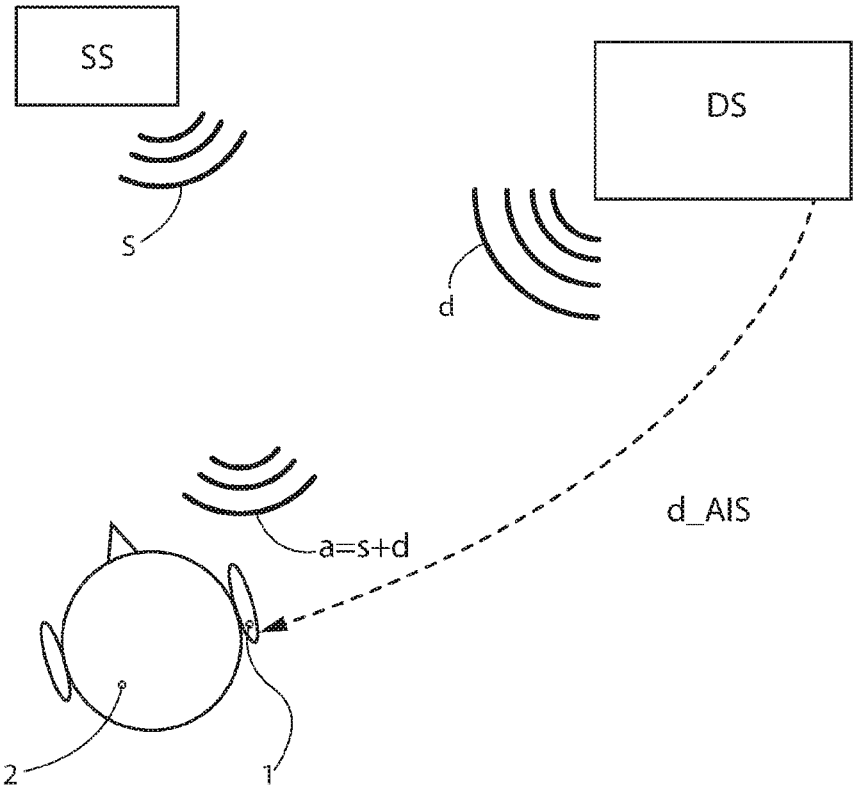
FIG. 1 schematically shows an arrangement comprising a hearing device user with inserted hearing device and a sound source for illustration of a first embodiment of the present invention, FIG. 2 schematically shows an arrangement comprising the hearing device user with inserted hearing device and the sound source for illustration of a second embodiment of the present invention.

FIG. 1 shows a top view of a hearing device user 2 wearing a hearing device 1 in or at one of his ears. Although the present invention is explained in connection with a monaural hearing device, the present invention can also very well be used in connection with a binaural hearing device. In fact, and as a result of the above-mentioned definition of the term "hearing device", the present invention can also very well be used in connection with any type of communication device.

Furthermore, FIG. 1 shows a sound source SS emitting an audio signal s that is important for the hearing device user 2 in that he or she is interested in the acoustic information of the audio signal s. The sound source SS may be of any type, in particular it may be one of the following:

another person speaking;

acoustic signal of a TV device, a hi-fi system, screen loudspeaker system (e.g. in a movie theater), or the like;

teller loudspeaker at a bank, post office, railway station, or the like;

surround sound of any type, in particular disturbing sounds.

Unfortunately, an input transducer of the hearing device not only picks up the audio signal s but, generally speaking, an acoustic signal a that comprises the audio signal s but also any other acoustic signals including a disturbing signal d that are present. For example, the disturbing signal d of a particular disturbing sound source DS is also picked up by the input transducer of the hearing device 1. As a result, the audio signal a of the input transducer of the hearing device 1 is a superposition of the acoustic signal s and the disturbing signal d.

According to the present invention, the disturbing signal d or at least characteristic features of the disturbing signal d are also available via a transmission signal d_AIS that is emitted by a transmitter unit (not shown in FIG. 1) comprised in the disturbing source DS. For example, the characteristic features transmitted in the transmission signal d_AIS are at least to some extend correlated to the acoustic disturbing signal d. For example, characteristic features of a disturbing signal may also be understood as the result of a filtering or coding process applied to the disturbing signal d. For example, a frequency filter could be applied to the disturbing signal d in order to generate the transmission signal d_AIS. In this case, the resulting transmission signal d_AIS would still be at some extend correlated to the disturbing signal d. Furthermore, characteristic features may also be information regarding the spectrum of the disturbing signal. For example, the spectrum of a disturbing signal may comprise one or several peaks. In this case, the characteristic features may comprise information about theses frequencies or about the phase of these frequencies.

The transmitter unit may also be attached to the disturbing source DS. The transmission signal d_AIS may be distributed by wire or wirelessly. In particular, the transmission signal d_AIS is distributed in one or more than one of the following manners:

wireless transmission: proprietary or standardized, e.g. FM—(Frequency Modulation), Bluetooth, WLAN (Wireless Local Area Network);

wired transmission;

Network with one or several transmission paths/links.

In order to receive the transmission signal d_AIS, the hearing device 1 comprises a receiving unit (not shown in FIG. 1) that is able to receive and decode the transmission signal d_AIS.

The audio signal a being a superposition of the acoustic disturbing signal d and the source signal s is picked up by the input transducer (not shown in FIG. 1) of the hearing device 1 and processed in the hearing device 1. As the transmission signal d_AIS comprises information on the disturbing signal d, the information can be used to get rid of the disturbing signal d in the audio signal a in order to obtain the source signal s of the sound source SS as clean as possible. The process of eliminating a known signal A from a superposition of signals A+B in order to obtain a signal B is well known in signal processing theory, in particular in the field of signal extraction and signal filtering. Reference is made to the standard publication of Claude S. Lindquist entitled "Adaptive and Digital Signal Processing" (Steward & Sons, Miami, Fla., 1989), in particular chapters 9 to 11.

The transmission signal d_AIS is an electric or electromagnetic signal comprising the disturbing signal d or its characteristic features. It is pointed out that the disturbing signal d or its characteristic features can be modulated in any form (e.g. frequency or amplitude modulated) or incorporated in any protocol in order to easily transmit the disturbing signal d to the hearing device 1 and receive the disturbing signal d in the hearing device 1.

In fact, the disturbing signal d is available in two forms in the hearing device 1: first, the acoustic disturbing signal d is incorporated into the audio signal a that is picked up by the input transducer of the hearing device. This is indicated by the signal a=s+d in front of the input transducer of the hearing device 1. Second, the disturbing signal d is incorporated into the transmission signal d_AIS that is provided by the disturbing source DS.

Figure 2:
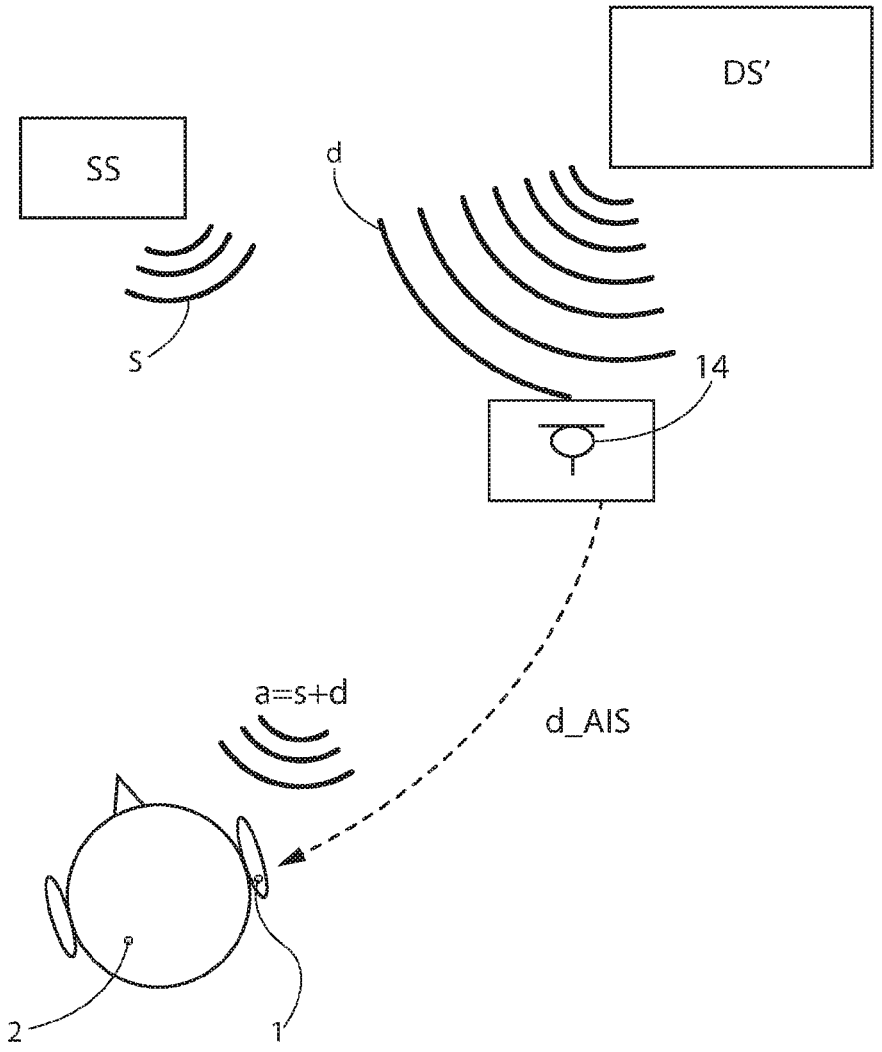

FIG. 2 schematically shows an arrangement comprising the hearing device user 2 with inserted hearing device 1 and the sound source SS for illustration of a second embodiment of the present invention. As in the embodiment depicted in FIG. 1, FIG. 2 comprises a disturbing source DS that is remotely arranged in relation to the hearing device user 2. As the disturbing source DS does not comprise a transmitter unit to transmit a transmission signal comprising the disturbing signal as has been the case for the embodiment depicted in FIG. 1, a further input transducer 14 is provided for generating the proper transmission signal d_AIS. Therefore, the further input transducer 14 is arranged, for example, in the vicinity of the disturbing source DS in order that the disturbing signal d does not comprise any other signal components that do not belong to the disturbing source DS. Again, the transmission signal d_AIS may comprise the entire disturbing signal d or may comprise characteristic features of the disturbing signal d.

For all embodiments of the present invention, the characteristic features may be one or several of the following features:

the disturbing signal d as time decimated sequence;

spectrum of the disturbing signal d;

spectrum of the disturbing signal d up to a predefined frequency or within a predefined frequency band;

an approximation of the disturbing signal d;

stochastic signal information.

The embodiment depicted in FIG. 2 is in particular useful if the disturbing source DS does not comprise a transmitter unit that is able to transmit the disturbing signal d or its characteristic features to the hearing device 1.

Figure 3:
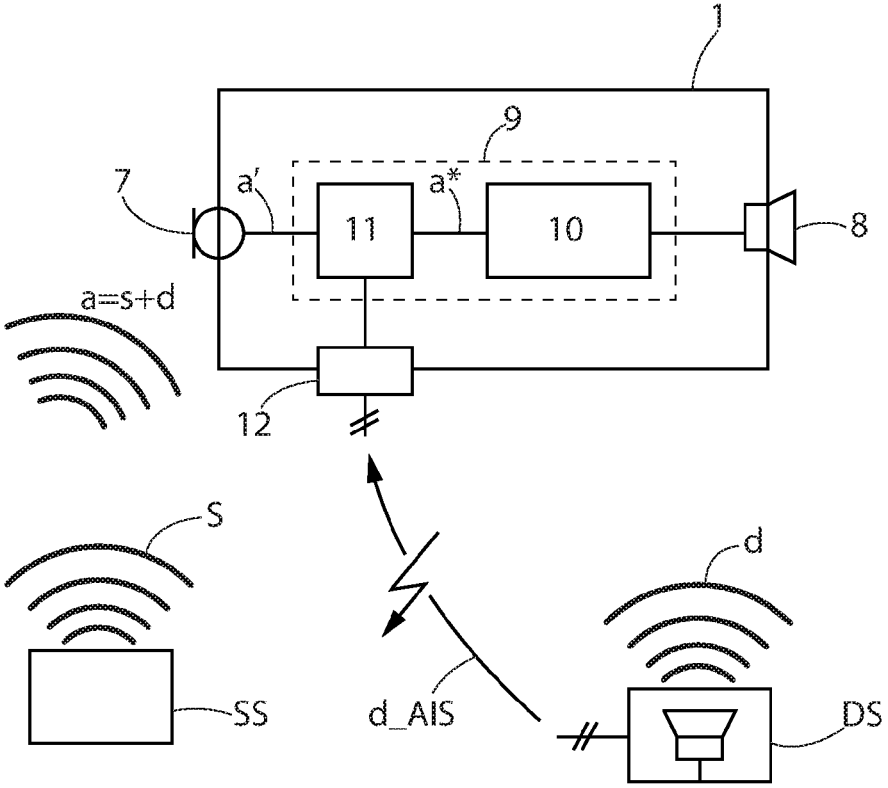
FIG. 3 shows a block diagram of a hearing device as well as a sound source.

FIG. 3 shows a block diagram of a hearing device 1 together with a sound source SS and a disturbing source DS. The hearing device 1 comprises an input transducer 7, a signal processing unit 9 with a pre-processing unit 11 and a post-processing unit 10, and an output transducer 8 that is also called receiver or loudspeaker in this technical field. Furthermore, the hearing device 1 comprises an interface unit 12 that is operationally connected to the signal processing unit 9, particularly to the pre-processing unit 11. The interface unit 12 is a receiving unit that is capable of receiving the transmission signal d_AIS comprising the disturbing signal d or its characteristic features. In case that the transmission signal d_AIS is transmitted wirelessly, antennas must be provided accordingly, i.e. in the interface unit 12 as well as in the disturbing source DS. Of course, a wired connection between the disturbing source DS and the interface unit 12 is also possible although it is less comfortable for the hearing device user 2.

The signal processing unit 9 comprises the pre-processing unit 11 and the post-processing unit 10 to illustrate that the audio signal a picked-up by the input transducer 7 is first processed in the pre-processing unit 11 to obtain an improved signal quality of the source signal s that is interesting for the hearing device user 2. In fact, the preprocessing unit 11 generates an adjusted audio signal a* that is an approximation of the source signal s.

The post-processing unit 10 represents the state of the art processing that takes place in a hearing device. Of course, the pre-processing unit 11 and the post-processing unit 10 can very well be implemented in the same processing unit as it has been indicated in FIG. 3 by the dashed line representing the signal processing unit 9.

It is to be understood that the above-described embodiments are merely illustrations of the present invention and that many variations of the above-described embodiments can be devised by those skilled in the art without departing from the scope of the invention. It is therefore intended that such variations be included within the scope of the following claims and there equivalents.

What is claimed is:

1. A method for operating a hearing device that is worn by a hearing device user, the method comprising steps of:

picking up an audio signal by an input transducer of the hearing device, the audio signal comprising a source signal of a sound source and a disturbing signal of a disturbing source, receiving a transmission signal via an interface unit of the hearing device, the transmission signal comprising the disturbing signal or at least characteristic features of the disturbing signal, wherein the transmission signal is emitted by a transmitter unit and the transmitter unit is attached to or comprised in the disturbing source, at least partially eliminating the disturbing signal from the audio signal by using the disturbing signal transmitted by the transmission signal or by using the characteristic features of the disturbing signal transmitted by the transmission signal for obtaining an adjusted audio signal, and processing the adjusted audio signal in the hearing device.

2. The method of claim 1, further comprising steps of:

calculating a correlation function between the disturbing signal transmitted by the transmission signal and the audio signal, determining a delay between the disturbing signal transmitted by the transmission signal and the disturbing signal superimposed on the source signal taking into account said correlation function, and eliminating the delay between the disturbing signal transmitted by the transmission signal and the disturbing signal superimposed on the source signal (s).

3. The method of claim 1, further comprising steps of:

picking up the disturbing signal by a further input transducer, and generating the transmission signal from the picked up disturbing signal (d).

4. The method of claim 1, further comprising the step of controlling by the hearing device user the step of at least partially eliminating the disturbing signal in the audio signal.

5. The method of claim 1, wherein the disturbing sound source comprises at least one of the following audio sources:

television set;

radio receiver;

HiFi—(High Fidelity)-unit;

an input transducer, such as a microphone.

6. The method of claim 1, wherein the transmission signal is transmitted to the interface unit (12) via implementation of one of the following techniques:

wireless transmission: proprietary or standardized, e.g. FM-(Frequency Modulation), Bluetooth, WLAN (Wireless Local Area Network);

wired transmission;

Network with one or several transmission paths/links.

7. The method of claim 1, wherein the characteristic features comprising at least one of the following:

a time decimated sequence of the disturbing signal (d);

a spectrum of the disturbing signal (d);

a spectrum of the disturbing signal up to a predefined frequency or within a predefined frequency band;

an approximation of the disturbing signal (d);

stochastic signal information of the disturbing signal (d).

8. A hearing device comprising:

an input transducer for picking-up an audio signal that comprises a source signal of a sound source and a disturbing signal of a disturbing source, an interface unit for receiving a transmission signal comprising a disturbing signal or at least characteristic features of the disturbing signal of a disturbing source, and wherein the transmission signal is emitted by a transmitter unit and the transmitter unit is attached to or comprised in the disturbing source, and a signal processing unit for at least partially eliminating the disturbing signal from the audio signal by using the disturbing signal transmitted by the transmission signal or by using the characteristic features of the disturbing signal transmitted by the transmission signal for obtaining an adjusted audio signal, the signal processing unit being operationally connected to the interface unit.

9. The hearing device of claim 8, further comprising:

means for calculating a correlation function between the disturbing signal transmitted by the transmission signal and the audio signal, means for determining a delay between the disturbing signal transmitted by the transmission signal and the disturbing signal superimposed on the source signal taking into account said correlation function, and means for eliminating the delay between the disturbing signal transmitted by the transmission signal and the disturbing signal superimposed on the source signal.

10. The hearing device of claim 8, further comprising:

a further input transducer for picking up the disturbing signal, wherein the transmitter unit generates the transmission signal from the picked up disturbing signal.

11. The hearing device of claim 8, further comprising a control unit operated by a hearing device user in order to control the signal processing unit for at least partially eliminating the disturbing signal from the audio signal.

12. The hearing device of one of the claims 8, wherein the disturbing source comprises at least one of the following audio sources:

television set;

radio receiver;

HiFi—(High Fidelity)-unit;

an input transducer, such as a microphone.

13. The hearing device of claim 8, wherein the transmission signal is transmitted to the interface unit via implementation of one of the following techniques:

wireless transmission: proprietary or standardized, e.g. FM-(Frequency Modulation), Bluetooth, WLAN (Wireless Local Area Network);

wired transmission;

Network with one or several transmission paths/links.

14. The hearing device of claim 8, wherein the characteristic features comprising at least one of the following:

a time decimated sequence of the disturbing signal;

a spectrum of the disturbing signal;

a spectrum of the disturbing signal up to a predefined frequency or within a predefined frequency band;

an approximation of the disturbing signal;

stochastic signal information of the disturbing signal.

* * * * *